US005188015A

United States Patent [19]

Hageman

[11] Patent Number: 5,188,015

[45] Date of Patent: Feb. 23, 1993

[54] AUTOMATICALLY SEQUENCED HYDRAULIC CYLINDER MECHANISM

[75] Inventor: Martin P. Hageman, Mequon, Wis.

[73] Assignee: Kelley Company, Inc., Milwaukee, Wis.

[21] Appl. No.: 814,007

[22] Filed: Dec. 26, 1991

[51] Int. Cl.[5] ..... F01B 7/18; F15B 15/17

[52] U.S. Cl. ..... 91/321; 91/417 R; 91/420; 137/116.3

[58] Field of Search ..... 91/415, 417 R, 321, 91/235, 420, 421, 433; 137/116.3, 116.5

[56] References Cited

U.S. PATENT DOCUMENTS

| | | | |
|---|---|---|---|
| 2,381,923 | 8/1945 | Obtresal | 91/417 R |
| 2,770,222 | 11/1956 | Anderson | 91/417 R |
| 2,991,758 | 7/1961 | Pfau | 91/417 R |
| 3,033,170 | 5/1962 | Norton et al. | 91/417 R |
| 3,685,077 | 8/1972 | Hageman | 14/71.7 |
| 3,795,255 | 3/1974 | Malott et al. | 91/420 X |
| 3,943,715 | 3/1976 | Miyao et al. | 91/417 R X |
| 4,555,975 | 12/1985 | Lang et al. | 91/417 R |

FOREIGN PATENT DOCUMENTS

| | | | |
|---|---|---|---|
| 2223995 | 5/1981 | Fed. Rep. of Germany | 91/417 R |
| 3611212 | 6/1987 | Fed. Rep. of Germany | 91/417 R |
| 0663896 | 5/1979 | U.S.S.R. | 91/417 R |

*Primary Examiner*—Edward K. Look
*Assistant Examiner*—Hoang Nguyen
*Attorney, Agent, or Firm*—Andrus, Sceales, Starke & Sawall

[57] ABSTRACT

An automatically sequenced hydraulic cylinder mechanism, including a hydraulic cylinder having a piston rod which is attached to a working member. The hydraulic system includes a pump which supplies hydraulic fluid to opposite sides of the cylinder. Due to the differential in surface area on opposite sides of the piston, the piston is moved in a direction to extend the piston rod. When the piston bottoms out in its stroke of travel, the pressure in the system is increased and the increased pressure will operate a three-position valve to decrease the pressure in one end of the cylinder and automatically retract the piston rod. The cylinder is thus automatically sequenced to extend the piston rod and retract the piston rod without the use of auxiliary switched or sensors.

7 Claims, 1 Drawing Sheet

AUTOMATICALLY SEQUENCED HYDRAULIC CYLINDER MECHANISM

BACKGROUND OF THE INVENTION

In certain types of equipment, such as compactors, log splitters, dock levelers, and the like, it is desirable for a hydraulic cylinder to operate in a programmed sequence, in which the piston rod is extended and then immediately retracted without operator action. To accomplish this sequencing, the cylinder unit normally includes limit switches, sensors, or complex valving, which substantially increases the overall cost of the unit.

Therefore, there has been a need for a simple and inexpensive mechanism for automatically sequencing a hydraulic cylinder and which may be retro-fitted to existing cylinders.

SUMMARY OF THE INVENTION

The invention is directed to an automatically sequenced hydraulic cylinder unit. The cylinder unit includes a cylinder and a piston is mounted within the cylinder and it carries a piston rod which projects through one end of the cylinder and is connected to a working member.

The hydraulic system for operating the cylinder includes a pump which is adapted to supply pressurized fluid through a pair of lines to opposite ends of the cylinder. As the fluid pressure operates on a larger surface area on the bottom face of the piston, as opposed to the upper face of the piston, which includes the piston rod, a differential in force is created which will move the piston upwardly to extend the piston rod. When the piston bottoms out against the upper head of the cylinder, the pressure will increase and when the pressure increases to a predetermined value it will shift a two-position, three-way valve, which is mounted in a line connecting the lower end of the cylinder with the reservoir, to release the pressure in the lower end of the cylinder. The piston will then move downwardly retracting the piston rod and the fluid from the lower end of the cylinder will be returned to the reservoir. A restrictor can be positioned in the return line to restrict the flow of fluid to the reservoir and maintain pressure in the upper end of the cylinder.

The invention provides an improved hydraulic system which will automatically sequence the extension and retraction of the piston rod by virtue of an increase of pressure in the system itself and without the need of auxiliary limit switches, sensors, or the like. The valve is automatically shifted by virtue of an increase of pressure in the system itself.

The system may be incorporated with either new or existing hydraulic cylinder systems and does not require the change or alteration of the hydraulic cylinder itself, for the sequence can be implemented merely by the incorporation of the two-position, three-way valve in the hydraulic system.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

The drawings illustrate a hydraulic cylinder unit that is automatically sequenced to extend the piston rod and retract the piston rod without the use of auxiliary limit switches, sensors, or the like. The hydraulic cylinder unit can be incorporated in any type of equipment which requires an automatic sequencing or reciprocating stroke of movement, such as for example, compactors, log splitters, dock levelers, or the like.

Figure 1:
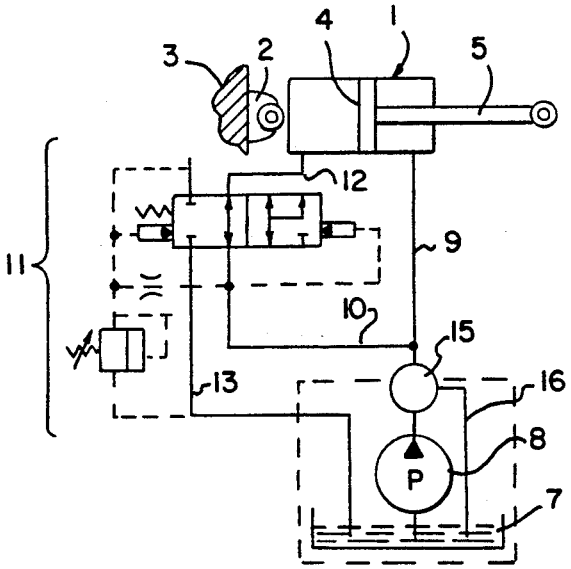
FIG. 1 is a schematic representation of the hydraulic system of the invention.

The hydraulic system is best illustrated in FIG. 1 and includes a cylinder 1 having its lower end pivotally connected to lugs 2 that are mounted on a fixed support 3. A piston 4 is mounted for sliding movement within cylinder 1 and carries a piston rod 5 that extends through the upper head of the cylinder and is connected to a working member.

The hydraulic system is best shown in FIG. 1 and includes a reservoir 7 to contain a hydraulic fluid. Pressurized fluid is pumped from reservoir 7 by pump 8 through line 9 to one end of cylinder 1. In addition, line 10 connects line 9 with a two-position, three-way valve assembly 11, and line 12 connects the valve assembly 11 to the opposite end of the cylinder. A return line 13 is connected between valve 11 assembly and the reservoir 7.

A shuttle valve 15 is located in line 9, and line 16 connects shuttle valve 15 with reservoir 7.

Valve assembly 11 is biased to a position where line 10 is normally in communication with line 12, as shown in FIG. 1.

Figure 2:
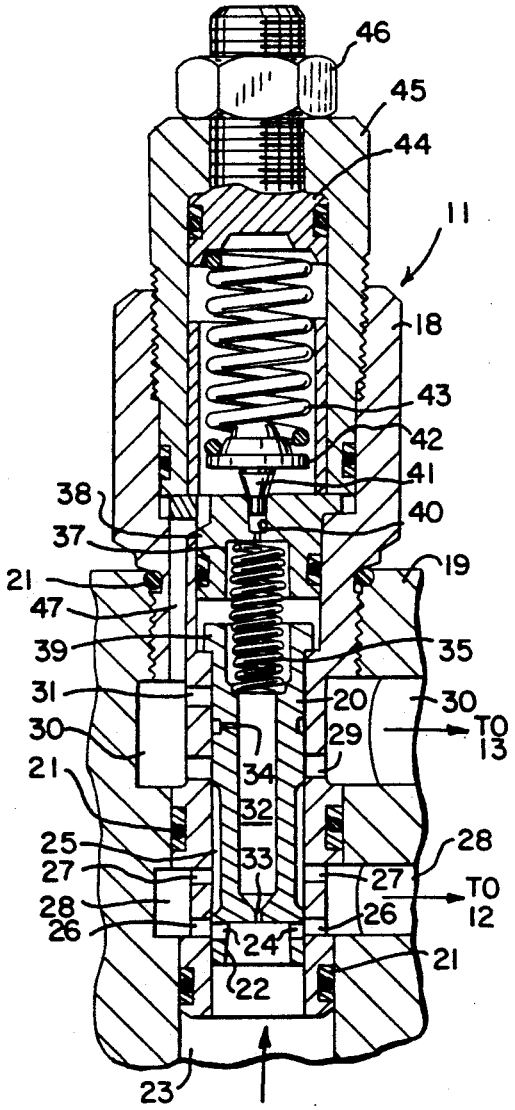
FIG. 2 is a longitudinal section of the three-position valve.
Figure 3:
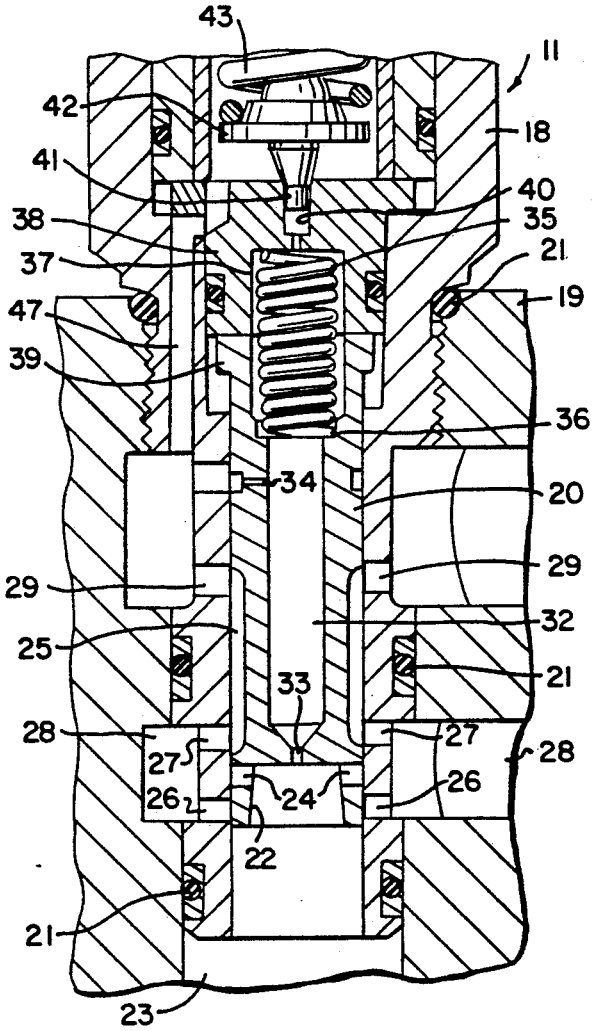
FIG. 3 is a view similar to FIG. 2 showing the valve in a second position.

The construction of valve assembly 11 is illustrated in FIGS. 2 and 3. The valve assembly 11 includes a tubular body 18 which is mounted within an opening in valve block 19 and a spool valve 20 is mounted for sliding movement within body 18. Body 18 is sealed within the opening in valve block 19 by suitable O-ring seals 21.

The outer end of spool valve 20 is provided with an axial recess 22, which is in communication with passage 23 of block 19 and passage 23, in turn, is connected to line 10, so that pressurized fluid will be supplied through line 10 to passage 23.

A series of radial passages 24 extend through the wall of spool valve 20 and communicate with the axial recess 22. In addition, spool valve 20 is provided with a peripheral groove 25, which is spaced longitudinally from passage 24.

As seen in FIG. 2, valve body 18 is formed with two groups of ports 26 and 27, and in the position of the valve 20, as shown in FIG. 2, ports 26 are in registry with ports 24 of the valve. Ports 26 and 27 communicate with passage 28 in valve block 19 and the passage 28 is in communication with line 12.

The valve body 18 also has a plurality of circumferentially spaced ports 29, which communicate with an annular chamber or passage 30, and passage 30 is connected to return line 13.

In addition, valve body 18 is also provided with a port 31 which is spaced axially from ports 29 and port 31 also communicates with passage 30.

As shown in FIGS. 2 and 3, valve 20 is provided with a central axis opening 32 and the outer end of the valve is provided with a small diameter orifice 33 which provides communication between opening 32 and passage 23. In addition, valve 20 is formed with a radial port 34 that is connected to the central opening 32.

Valve 20 is biased to the position shown in FIG. 2 by a coil spring 35. One end of spring 35 bears against an internal shoulder 36 in valve 20, while the opposite end of the spring is received within an axial recess 37 in seat 38, which is mounted in the valve body 18. The force of spring 35 urges valve 20 outwardly to the position shown in FIG. 2, and outward displacement of the valve from the valve body 18 is prevented by engagement of the peripheral flange 39 on valve 20 with an internal shoulder on valve seat 18.

Valve seat 38 is provided with a small diameter central opening 40, which is enclosed by a poppet valve 41. Valve 41 includes a small diameter end which is received within opening 40 and an enlarged head 42.

To bias poppet valve 41 to a closed position, a coil spring 43 is interposed between head 42 and an adjusting screw 44, which is threaded within a central opening in cap or spring housing 45. The cap 45 is threaded within the outer end of valve body 18. By threaded adjustment of screw 44, the force of the spring 43 can be adjusted, thereby selectively varying the force required to open poppet valve 41. This adjustment is independent of the biasing force of spring 35 which biases valve spool 20 to the outer position, shown in FIG. 2.

A lock nut 46 can be engaged with the outer end of screw 44 to lock the screw in the desired position.

As shown in FIGS. 2 and 3, a longitudinal passage 47 is formed in valve body 18 and valve seat 38 and provides communication between the interior of cap 45 and chamber 30 in valve block 19. When poppet valve 41 is opened, fluid can flow from the interior of the valve 20 through the opening 40 and then through the passage 47 and chamber 30 to reservoir 7.

When it is desired to extend piston rod 5, pump 8 is operated causing pressurized fluid to be supplied through line 9 to one end of cylinder 1 and through line 10, valve assembly 11 and line 12 to the opposite end of the cylinder 1.

The fluid pressure supplied through line 10 to control valve 11 will act against spool valve 20 and due to the orifice 33, the pressure will be applied to both ends of the valve 20. As the force of the fluid pressure acting on the exposed area of the outer end of the spool valve 20 is equal to the force acting on the inner end of the spool valve (the sum of the force of spring 35 plus the force of the fluid pressure acting on the exposed area of the inner end), the valve 20 will be maintained in the position as shown in FIG. 2. In this position, ports 24 will communicate through ports 26 with the annular chamber 28, which in turn is connected through line 12 to the cylinder 1, so that the pressurized fluid will be applied to both ends of the cylinder.

As the inner face of the piston 4 has a greater surface area than the outer face of the piston, due to the attachment of the piston rod 5 to the outer face, a differential in force is created which will move the piston 4 and extend the piston rod 5. When the piston 4 of cylinder 1 reaches the end of its outward stroke and bottoms out, or if the piston rod 5 hits an obstruction, the pressure in lines 9 and 10 will increase.

The increased pressure acting through valve 20 will also be applied to the inner small diameter end of poppet valve 41, which is biased to a closed position by spring 43. When the pressure increases to a predetermined value, it will overcome the force of spring 43, and poppet valve 41 will open, allowing fluid to flow through opening 40 to the interior of cap 45 and then through passage 47, to annular passage 30 and then to the reservoir 7. As fluid flows through the valve 20, it passes through the small diameter orifice 33, causing a pressure drop across the orifice which is sufficient to produce a higher force on the outer end of valve 20, as opposed to the inner end. This differential in force will move the valve 20 axially against the force of spring 35 to the position shown in FIG. 3. In this position, the ports 24 will be closed off and port 34 will be in communication through port 31 with the chamber 30 and reservoir 7 and ports 27 will communicate through peripheral groove 25 with ports 29 and chamber 30 so that fluid will flow from cylinder 1 through line 12, through valve assembly 11 and line 13 to the reservoir. Thus, the lower end of cylinder 2 will be connected through control valve assembly 11 to the reservoir 7 and the pressure of the fluid acting through line 9 to the upper end of the cylinder 1 will cause the piston rod 5 to retract. When piston rod 5 is fully retracted the operator can discontinue operation of pump 8.

The sequence pressure, which is the pressure in excess of that required to shift the valve 20, is determined by the force of spring 43, and the return pressure, which is the pressure at which the valve 20 will return to its original position, as seen in FIG. 3, is the pressure determined by the force of spring 35. In practice, the sequence pressure is set at a substantially higher value than the return pressure, generally in the ratio of about 10:1. Through operation of the adjusting screw 44, the sequence pressure can be adjusted independently of the return pressure. Thus, a low return pressure can be obtained, while providing an independent adjustment of the sequence pressure.

The invention provides a simple, and inexpensive mechanism for automatically sequencing the cylinder in an extended and retracted stroke of movement. The valve assembly 11 is automatically shifted by virtue of an increase in pressure of the system itself, as opposed to utilizing an auxiliary shifting mechanism, such as sensors, limit switches, or the like. In addition, the mechanism of the invention can be utilized to sense an overpressure situation, as for example, when a reciprocating member such as a piston rod, engages an obstruction, and in this situation, the mechanism will automatically reverse operation of the reciprocating member to provide a safety function.

The system can be incorporated either with new or existing hydraulic cylinder units and does not require the modification or reconstruction of the cylinder itself, for the sequencing is accomplished merely by the addition of the valve assembly 11 in the system.

Various modes of carrying out the invention are contemplated as being within the scope of the following claims particularly pointing out and distinctly claiming the subject matter which is regarded as the invention.

I claim:

1. A hydraulic mechanism comprising a valve body defining a first chamber and a second chamber and having a passage providing communication between said first and second chambers, inlet means communicating with said first chamber for introducing hydraulic fluid to said first chamber, port means communicating with said first chamber for discharging hydraulic fluid from said first chamber and including a first port communicating with a working member and a second port connected to a reservoir for said fluid, first valve means disposed in said first chamber and having a first position connecting said inlet means with said first port whereby fluid will be supplied to said working member and having a second position connecting said first port with said second port whereby fluid will be returned from said working member to said reservoir, first biasing means for biasing said first valve means to said first position, second valve means disposed in said second chamber for opening and closing said passage, second biasing means for biasing the second valve means to a closed position, said first valve means having a pair of opposed ends and having a longitudinal bore including orifice means, said first valve means being constructed and arranged such that the pressure of said fluid introduced through said inlet means acts through said bore and on said opposite ends of said first valve means to maintain said first valve means in said first position, an increase in pressure in said hydraulic system exceeding the force of said second biasing means on said second valve means acting to open said second valve means and the subsequent flow of fluid through said orifice means creating a pressure differential to enable said first biasing means to urge said first valve means to said second position.

2. The mechanism of claim 1, wherein said first biasing means comprises a spring disposed in said first chamber and interposed between an abutment on said housing and said first valve means.

3. The mechanism of claim 2, wherein said second biasing means comprises a second spring disposed in said second chamber and interposed between said second valve means and a second abutment on said housing.

4. The mechanism of claim 3, and including means for adjusting the force of said second spring.

5. The mechanism of claim 3, wherein the force of said second spring is greater than the force of said first spring.

6. The mechanism of claim 5, wherein the force of said second spring is about ten times greater than the force of said first spring.

7. The mechanism of claim 1, wherein said working member comprises a cylinder containing a slidable piston and said mechanism also includes pumping means communicating with said reservoir, first conduit means connecting said pumping means with a first end of said cylinder, second conduit means connecting said pumping means to said inlet means, third conduit means connecting said first port to a second end of said cylinder, and fourth conduit means connecting said second port to said reservoir.

* * * * *